US009494159B2

(12) United States Patent
Bryditzki et al.

(10) Patent No.: US 9,494,159 B2
(45) Date of Patent: Nov. 15, 2016

(54) WATER PUMPING SYSTEM FOR ROOFTOP APPLICATIONS AND THE LIKE

(71) Applicants: Nicholas Bryditzki, Azle, TX (US); Dennis Allen Grubb, Socorro, NM (US)

(72) Inventors: Nicholas Bryditzki, Azle, TX (US); Dennis Allen Grubb, Socorro, NM (US)

(73) Assignee: Nicholas Bryditzki, Azle, TX (US)

( * ) Notice: Subject to any disclaimer, the term of this patent is extended or adjusted under 35 U.S.C. 154(b) by 364 days.

(21) Appl. No.: 14/158,794

(22) Filed: Jan. 18, 2014

(65) Prior Publication Data

US 2015/0204333 A1 Jul. 23, 2015

(51) Int. Cl.

| | |
|---|---|
| ***F04D 15/02*** | (2006.01) |
| ***F04D 13/06*** | (2006.01) |
| ***F04B 23/02*** | (2006.01) |
| ***F04B 23/14*** | (2006.01) |
| ***F04D 29/40*** | (2006.01) |
| ***F04B 17/00*** | (2006.01) |
| ***F04D 9/02*** | (2006.01) |
| ***F04F 10/00*** | (2006.01) |
| ***F04D 13/08*** | (2006.01) |
| *B63B 22/24* | (2006.01) |

(52) U.S. Cl.

CPC ..... *F04D 15/0218* (2013.01); *F04B 17/006* (2013.01); *F04B 23/021* (2013.01); *F04B 23/14* (2013.01); *F04D 9/02* (2013.01); *F04D 13/068* (2013.01); *F04D 13/08* (2013.01); *F04D 29/406* (2013.01); *F04F 10/00* (2013.01); *B63B 22/24* (2013.01)

(58) Field of Classification Search

CPC ..... F04D 13/06; F04D 13/068; F04D 13/08; F04D 13/086; F04D 15/0218; F04D 29/40; F04D 29/406; F04D 9/02; F04D 9/007; F04B 17/006; F04B 23/00; F04B 23/02; F04B 23/021; F04B 23/023; F04B 23/04; F04B 23/08; F04B 23/14; B63B 22/24; F04F 10/00

USPC ..... 417/36, 199.1, 200, 201; 137/142

See application file for complete search history.

(56) References Cited

U.S. PATENT DOCUMENTS

| | | | | |
|---|---|---|---|---|
| 4,248,258 | A * | 2/1981 | Devitt | E04D 13/0404 137/124 |
| 5,970,999 | A * | 10/1999 | Greenia | F04F 10/00 119/250 |
| 7,455,582 | B2 * | 11/2008 | Barrett | E04H 1/1216 135/91 |
| 9,028,288 | B2 * | 5/2015 | Lovett | A45B 3/00 441/1 |
| 2006/0144439 | A1 * | 7/2006 | Bell | F04F 10/00 137/147 |
| 2009/0016901 | A1 * | 1/2009 | Morris, III | F04B 13/00 417/200 |
| 2014/0231328 | A1 * | 8/2014 | Sheehy | E03B 3/02 210/191 |

* cited by examiner

*Primary Examiner* — Bryan Lettman
*Assistant Examiner* — Chirag Jariwala
(74) *Attorney, Agent, or Firm* — David O. Simmons

(57) ABSTRACT

Embodiments of the present invention are directed to a water pumping system. More specifically, embodiments of the present invention are directed to a solar electric powered, siphon-capable water pumping systems specifically configured for use in rooftop and other applications having similar need and conditions. Advantageously, a water pumping system configured in accordance with an embodiment of the present invention is configured to prevent pooling of water in low-lying areas of a roof and thereby limits the potential for damage to the roof and underlying structure that could otherwise result from such pooling of the water.

14 Claims, 4 Drawing Sheets

WATER PUMPING SYSTEM FOR ROOFTOP APPLICATIONS AND THE LIKE

FIELD OF THE DISCLOSURE

The disclosures made herein relate generally to water pumping system and, more particularly, to a solar electric powered water pumping systems specifically configured for use in rooftop and other applications having similar need and conditions.

BACKGROUND

While a pitched roof is a roofing construction approach usually adopted in relatively small building constructions, such as dwellings and the like, flat roof constructions are often employed in larger buildings where the roof extends over a greater area. Any tendency for flat roof constructions to settle or sag almost invariably results in the creation of areas on the flat roof spaced from the supports and downspouts which are lower than the areas where the roof is supported. These lower areas become water pooling areas during a rain condition. Although flat roof constructions are particularly susceptible to water pooling, low-lying areas (e.g., shallow valleys) of a pitched roof or areas of a pitched roof where a drain, gutter, or downspout has become blocked can be susceptible to water pooling.

It is well known that the accumulation of water on a roof of a building, whether of flat or pitched construction, generally presents undesirable conditions that lead to associated damage of the building, equipment located on the roof of the building, or both. For example, pooling of water accelerates the deterioration of roofing materials, which can result in damage to underlying materials and structure of the building. Furthermore, pooled water on a rood further contributes to sagging of the roof and unintended loadings on underlying structure. Therefore, a solar electric powered water pumping systems specifically configured for use in rooftop and other applications having similar need and conditions would be beneficial, desirable and useful.

SUMMARY OF THE DISCLOSURE

Embodiments of the present invention are directed to a water pumping system. More specifically, embodiments of the present invention are directed to a solar electric powered water pumping systems specifically configured for use in rooftop and other applications having similar need and conditions. Advantageously, a water pumping system configured in accordance with an embodiment of the present invention is configured to prevent pooling of water in low-lying areas of a roof and thereby limits the potential for damage to the roof and underlying structure that could otherwise result from such pooling of the water.

In one embodiment of the present invention, a water pumping system comprises a housing having at least one internal chamber, an electrical power supply apparatus, a pump actuation device, a water pump, and a solar electric panel. The electrical power supply apparatus is located in the at least one internal chamber. One or more water inlet passages and one or more water outlet passages extends between an exterior surface of the housing and an interior space of the at least one internal chamber. The electrical power supply apparatus includes a water pump power output interface, a pump actuation signal interface and a power input interface. The electrical power supply apparatus intermittently outputs electrical power to the water pump power output interface for each instance of a prescribed time period during which a water level signal is provided at the water presence signal interface. The pump actuation device is located within the at least one internal chamber. The pump actuation device is electrically connected to the pump actuation signal interface of the electrical power supply apparatus for enabling the water presence signal to be provided therefrom to the pump actuation signal interface when the pump actuation device detects at least pump actuation condition exists. The water pump is located within the at least one internal chamber and has a water outlet thereof connected to the at least one water outlet passage of the housing. The water pump is electrically connected to the water pump power output interface of the electrical power supply apparatus for enabling the intermittently outputted electrical power to be provided thereto. The water pump is operable in a non-powered state for causing water to flow through a passage extending between a water inlet of the water pump and the water outlet of the water pump by a siphon effect initiated by priming the passage extending between the water inlet of the water pump and the water outlet of the water pump water pump with water as a result of at least one period of electrical power provided to the water pump during an instance of the intermittent output of electrical power to the water pump power. The solar electric panel is mounted on the exterior surface of the housing. The solar electric panel is electrically connected to the power input interface of the electrical power supply apparatus.

In another embodiment of the present invention, a water pumping system comprises a housing, an electrical power supply apparatus, a water level sensing device, and a water pump. The housing has a first internal chamber and a second internal chamber. One or more passage extends between an interior space of the first internal chamber and an interior space of the second internal chamber. One or more water inlet passages and one or more water outlet passages extend between an exterior surface of the housing and the interior space of the second internal chamber. The electrical power supply apparatus is located in the first internal chamber. The electrical power supply apparatus includes a water pump power output interface and a water level signal interface. The electrical power supply apparatus intermittently outputs electrical power to the water pump power output interface for each instance of a prescribed time period during which a water level signal is provided at the water level signal interface. The water level sensing device is located within the second internal chamber. The water level sensor is electrically connected to the water level signal interface of the electrical power supply apparatus by a water level signal conducting structure that extends through at least one of the passage that extending between the interior space of the first internal chamber and the interior space of the second internal chamber for enabling the water level signal to be provided therefrom. The water pump is located within the second internal chamber and having a water outlet thereof connected to one or more of the water outlet passages of the housing. The water pump is electrically connected to the water pump power output interface of the electrical power supply apparatus by an electrical power transmitting structure that extends through one or more of the passages extending between the interior space of the first internal chamber and the interior space of the second internal chamber for enabling the intermittently outputted electrical power to be provided thereto. The water pump is operable in a non-powered state for causing water to flow through a passage extending between a water inlet of the water pump and the water outlet of the water pump at least partially by a siphon effect generated by priming the passage extending between the water inlet of the water pump and the water outlet of the water pump with as a result of at least one period of electrical power provided to the water pump during an instance of the intermittent output of electrical power to the water pump power.

In another embodiment of the present invention, a water pumping system comprises a housing, a water pump, a water level sensing device, a solar electric panel, a battery, and a power control module. The housing has a base, a hood and an interior space divider. The base has a bottom wall and an upper edge portion. The hood has a top wall and a lower edge portion. The interior space divider is mounted on a mating interior surface of the base thereby defining a first internal chamber between the base and the interior space divider. The upper edge portion of the base is engaged with the lower edge portion of the hood thereby defining a second internal chamber between the hood and the interior space divider. One or more passage extends though the interior space divider. One or more water inlet passages extend between an exterior surface of the base and the first internal chamber. One or more water outlet passages extend between the exterior surface of the base and the first internal chamber. The water pump is located within the first internal chamber and has a water outlet thereof connected to the at least one water outlet passage of the base. The water level sensing device is located within the first internal chamber. The solar electric panel is mounted on the hood, the base, or both. The battery and the power control module are located within the second internal chamber. The power control module is electrically coupled to the battery, the solar electric panel, the water level sensing device and the water pump. The power control module causes electrical power to be provided to the water pump from the battery, the solar electric panel or both when a water level signal is received thereby from the water level sensing device.

These and other objects, embodiments, advantages and/or distinctions of the present invention will become readily apparent upon further review of the following specification, associated drawings and appended claims.

DETAILED DESCRIPTION

Embodiments of the present invention are directed to a water pumping system configured for use in rooftop and other applications having similar need and conditions. One primary use is flat roof constructions. As is discussed below in greater detail, a preferred embodiment of a water pumping system configured in accordance with the present invention is solar electric powered and has a water pump capable of operating via a siphon effect when in a non-powered state. Advantageously, such a water pumping system can prevent pooling of water in low-lying areas of a roof and thereby limits the potential for damage to the roof and underlying structure that could otherwise result from such pooling of the water.

Figure 1:
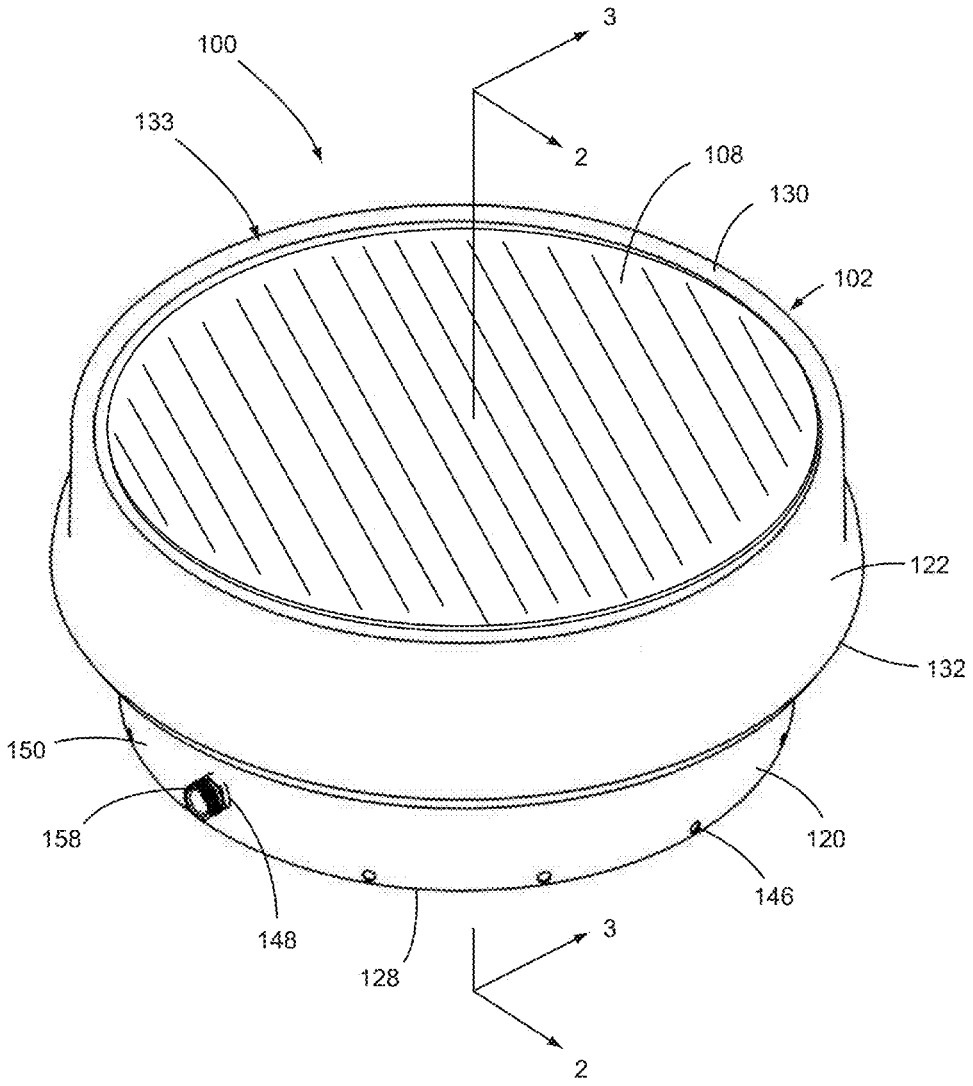
FIG. 1 is a perspective view showing a water pumping system configured in accordance with an embodiment of the present invention.
Figure 2:
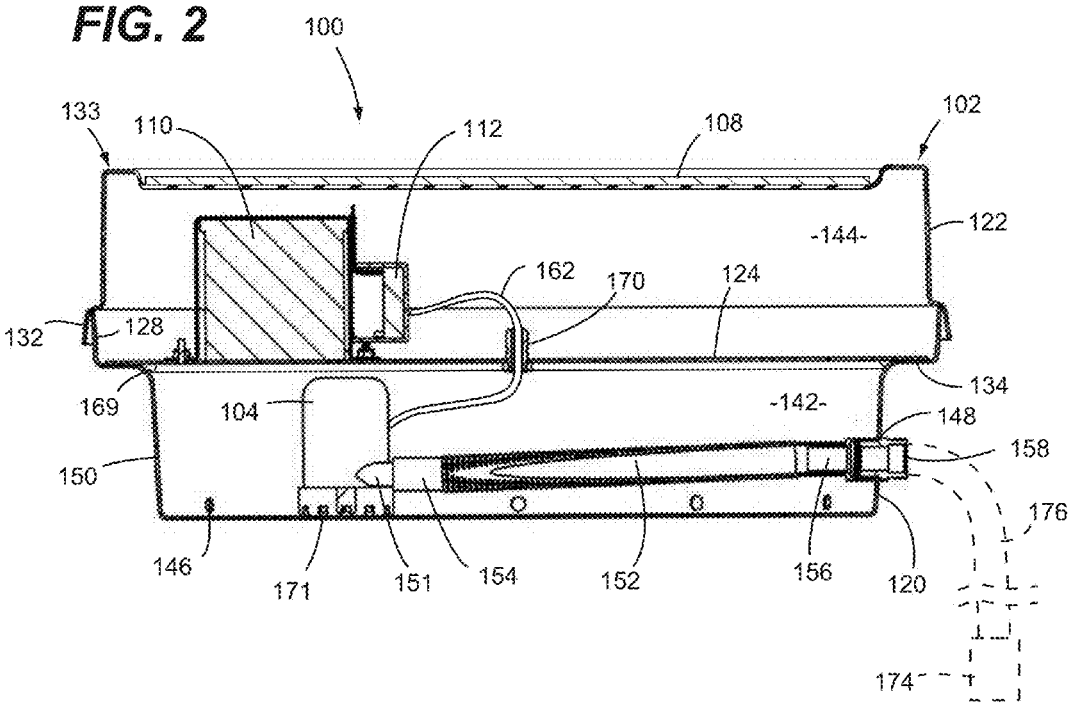
FIG. 2 is a cross-sectional view taken along the line 2-2 in FIG. 1.
Figure 3:
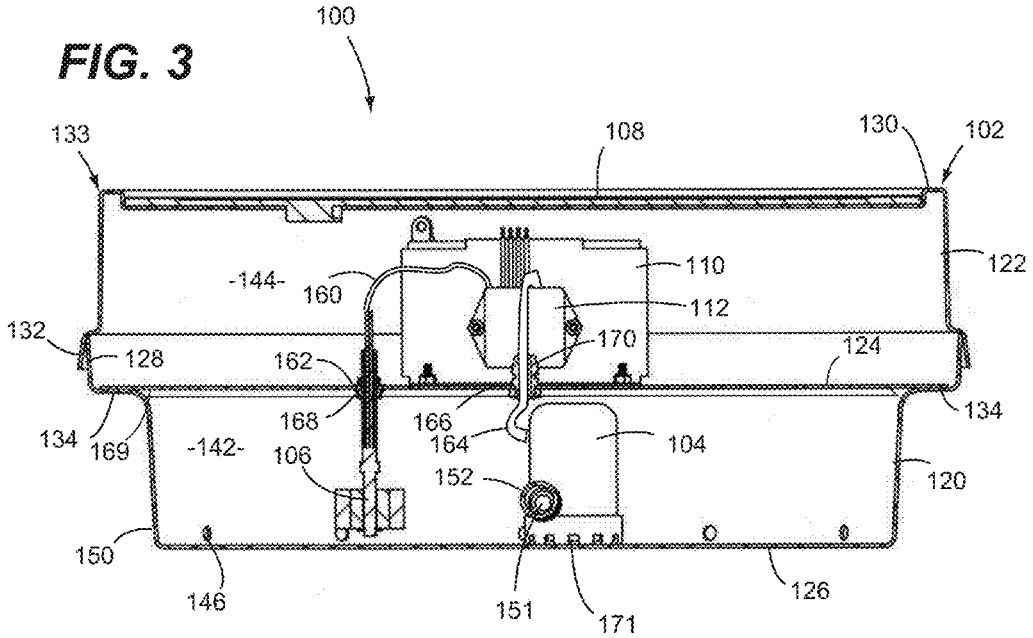
FIG. 3 is a cross-sectional view taken along the line 2-2 in FIG. 1.
Figure 4:
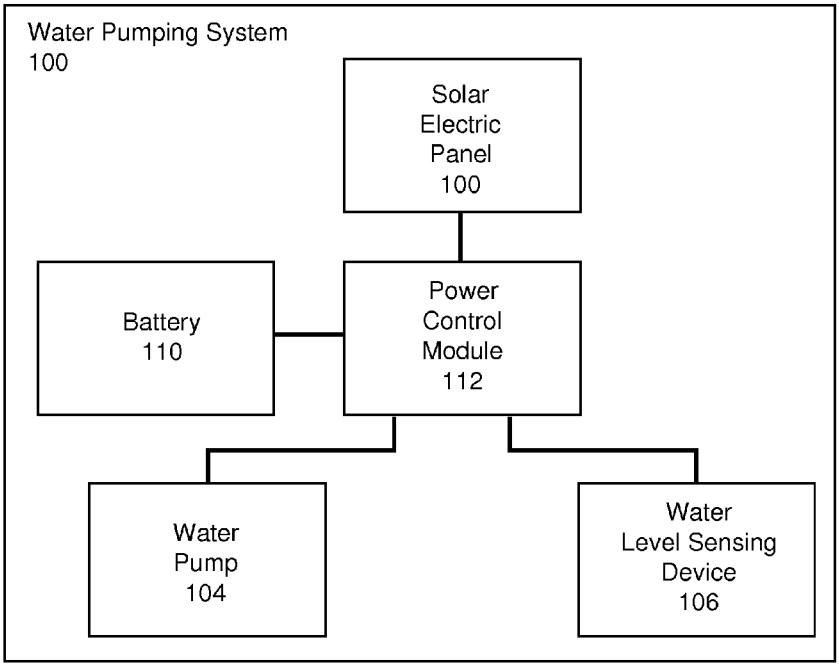
FIG. 4 is a block diagram showing the electrical system components of the water pumping system of FIG. 1.

FIGS. 1-3 show various aspects of a water pumping system 100 configured in accordance with an embodiment of the present invention. The water pumping system 100 includes a housing 102, a water pump 104, a water level sensing device 106, a solar electric panel 108, a battery 110, and a power control module 112. The power control module 112 is electrically connected to the water pump 104, the water level sensing device 106, the solar electric panel 108 and the battery 110 such as, for example, each through a respective interface of the power control module 112. As will be discussed below in greater detail, the power control module 112 causes electrical power from the solar electric panel 108, the battery 110 or both to be provided to the water pump 104 when a water level signal is received by the power control module 112 from the water level sensing device 106. As will also be discussed below in greater detail, the power control module 112 causes electrical power from the solar electric panel 108 to be provided to the battery 110 for maintaining the battery 110 in a suitable state of charge.

The power control module 112 and the battery 110 jointly define one embodiment of an electrical power supply apparatus configured in accordance with the present invention. However, embodiments of the present invention are not limited to a particular configuration of electrical power supply apparatus. For example, the power control module 130 can include an interface for receiving power via a line source (i.e., utility power supply of a building) and a power converting portion for converting line source power to a configuration of power suitable for being introduced into the battery 110 for charging purposes and/or the water pump 104 for operating purposes.

In the embodiment of the water pumping system 100 shown in FIGS. 1-2, the housing 102 has a base 120, a hood 122 and an interior space divider 124. The base 120 has a bottom wall 126 and an upper edge portion 128. The hood 122 has a top wall 130 and a lower edge portion 132. The interior space divider 124 is mounted on a ledge 134 (i.e., a mating interior portion) of the base 120 thereby defining a first internal chamber 142 between the base 120 and the interior space divider 124. The upper edge portion 128 of the base 102 is engaged with the lower edge portion 132 of the hood 122 thereby defining a second internal chamber 144 between the hood 122 and the interior space divider 124. Water inlet passages 146 and a water outlet passage 148 extend through a wall of the base 120 between an exterior surface 150 of the base 120 and the first internal chamber 142.

In preferred embodiments, the base 120 and the hood 122 can be spun from aluminum material and the interior space divider 124 can be a flat or contoured piece of aluminum sheet. Accordingly, the base 120 and the hood 122 preferably are each made from a single piece of material and have a round shape thereby limiting potential leak points such as resulting from seams or welds. The manner in which the upper edge portion 128 of the base 102 is engaged with the lower edge portion 132 of the hood 122 forms a skirt that limits the propensity for water to leak into the housing at the interface between the base 120 and the hood 122. Preferably, a water tight seal is provided between the hood 122 and any components (e.g., control switch, solar electric panel cable, etc) that are mounted within or pass through a passage within the hood 122.

The water pump 104 and the water level sensing device 106 are located within the first internal chamber 142. The battery 110 and the power control module 112 are located within the second internal chamber 144 (e.g., mounted on a surface of the interior space divider 124). A water outlet 151 of the water pump 104 is connected to the water outlet passage 148. In the embodiment depicted in FIGS. 1-3, a hose 152 or other suitable type of plumbing implement has a first end portion 154 connected to the water outlet 151 of the water pump 104 and has a second end portion 156 connected to a coupling 158 (e.g., threaded nipple/collar) that is mounted within the water outlet passage 148. In another embodiment (not shown), the water outlet 151 of the water pump 104 can have a coupling (e.g., threaded nipple/collar) that is mounted within the water outlet passage 148. In preferred embodiments, the coupling at the water outlet passage 148 is suitably configured for being attached to a hose, rigid pipe or the like such as via a threaded interface, glued fitment or the like.

A signal conducting structure 160 (e.g., wires or cable), which is coupled between the water level sensing device 106 and the power control module 112, extends through a first passage 162 in the interior space divider 124. A power conducting structure 164 (e.g., wires or cable), which is coupled between the water pump 104 and the power control module 112, extends through a second passage 166 within the interior space divider 124. A first water-tight seal is provided between the signal conducting structure 160 and the interior space divider 124 within the first passage 162 (e.g., via a grommet 168). A second water-tight seal is provided between the power conducting structure 164 and the interior space divider 124 within the second passage 166 seal (e.g., via a grommet 170). A water-tight seal can be provided between the interior space divider 124 and the base 120 (e.g., the ledge 134) by means 169 such as, for example, an polymeric sealing device (e.g., an O-ring), a gasket, a layer of sealant, or the like.

In the embodiment depicted in FIGS. 1-3, the solar electric panel 108 is mounted on the hood 122. For example, the solar panel can be mounted on the top wall 130 of the hood 122 by means such as, adhesive, mechanical fasteners of the like. Alternatively, the solar electric panel 108 can also be entirely or partially mounted on the base 120. The hood 122 and the solar panel 108 are jointly referred to herein as a hood assembly 133.

The water level sensing device 106 is an example of a device that senses the presence of water within the base 120 of the housing 102. More specifically, the water level sensing device 106 can be a vertical float level sensor that uses a reed switch that transitions between an open circuit condition and a closed circuit condition based on water level within the base 120. The water level sensing device 106 can include a float device that is connected to the reed switch and that rises and falls with water level in the base 120. Buoyancy of the float can be specified and/or adjusted to affect the rate at which the water level sensing device 106 transitions between the open circuit condition and the closed circuit condition for a given change in depth of water within the base 120. The open circuit condition and the closed circuit condition are used to control electrical power provided from the battery 110 and/or solar panel 108 to the water pump 104. In this regard, power can be provide directly from a power source (e.g., the battery 110 and/or solar panel 108) to the water pump 104 with output of the water level sensing device 106 being a control signal provided to the power control module 112 for determining if power is to be provided to the water pump 104. Alternatively, the water level sensing device 106 can be implemented in series between the power source and the water pump 104 for directly controlling electrical current provided to the water pump 104 from the power source.

The power control module 112 provides a variety of functionalities. One such functionality is causing electrical power generated at the solar panel 108 to be used for charging the battery 110. Another such functionality is causing electrical power from the battery 110 and/or the solar panel 108 to be selectively provided to the water pump 104 dependent upon a state of operation of the water level sensing device 106 (e.g., electrical power provided from the battery 110 and/or solar panel to the water pump 104 when a switch of the water level sensing device 106 is in a closed state (e.g., water level above a minimum prescribed level) and electrical power not being provided from the battery 110 and/or solar panel 108 to the water pump 104 when the switch of the water level sensing device 106 is in an open state (e.g., water level below the minimum prescribed level). As discussed below in greater detail, the power control module 112 causing electrical power from the battery 110 and/or the solar panel 108 to be selectively provided to the water pump 104 can comprise the power control module 112 intermittently outputting electrical power to the water pump for each instance of a prescribed time period during which a water level signal is provided to the power control module 112 from the water level sensing device 106. It is disclosed herein that the power control module 112 can be configured as a plurality of separate but interconnected controllers such as, for example, a battery charging controller and a power distribution controller.

The power control module 112 can be configured to control electrical power supply to the water pump 104 dependent upon ambient temperature. Attempting to operate the water pump during ambient conditions where water within the water pump, surrounding the water pump 104 and/or surrounding the water pumping system 100 can result in damage to the water pump 104 and other components of the water pumping system 100. Accordingly, the power control module 112 can be suitably configured to provide freeze protection functionality (e.g., through the use of a temperature sending device) that inhibits electrical power from being provided to the water pump 104 when the ambient temperature is at or below a prescribed threshold temperature (e.g., 35 degrees Fahrenheit). Alternatively or in combination with the temperature-governed freeze protection functionality described above, the power control module 112 can be configured (e.g., with a temperature sensing device) to inhibit electrical power from being provided to the water pump 104 when a current draw by the water pump 104 exceeds a prescribed threshold current draw that would indicate an impeller of the water pump is encased in ice and is not turning (i.e., pump over-load protection functionality).

In a preferred embodiment of the present invention, the water pump 104 is operable (i.e., flows water therethrough) in both a powered state (i.e., receiving electrical power from the battery 110 and/or solar panel 108) and a non-powered state. The water pumping system 100, which is a water pumping systems configured in accordance with preferred embodiments of the present invention, is configured to flow water through the water pump 104 via a siphon effect when the water pump 104 is in a non-powered state. The siphon effect is based on a difference in vertical position of a water inlet and water outlet of a water flow circuit that passing through the water pump 104. The water inlet of the water flow circuit is located at a water inlet 171 of the water pump 104 and the water outlet is that at the terminal end 174 of a fluid communication conduit 176 (e.g., hose or pipe) connected to the coupling 158 that is mounted within the water outlet passage 148. For example, the water outlet of the water flow circuit being 5 feet or more below the water inlet of water flow circuit and terminating into a space at atmospheric conditions can provide for a suitable siphon effect through a typical commercially-available bilge pump (e.g., Rule brand bilge pump model no. 25D).

Use of the siphon effect to maintain the flow of water through the water flow circuit is advantageous because the battery 110 can only power the water pump 104 for a limited period of time prior to discharge of the battery. This limited period of time can be substantially less than a total period of time required for pumping a given amount of water. Although charging of the battery 110 may extend the limited period of time that the battery 110 can power the water pump 104, ambient condition may limit operability of the solar panel in times when operation of the water pumping system 100 is required. Accordingly, embodiments of the present invention advantageously implement one or more intermittent water pump powering techniques to limit reliance on the battery for pumping water.

The one or more intermittent water pump powering techniques are implemented by the power control module 112 to initiate the siphon effect within the water flow circuit (i.e., including a water flow passage extending between the water inlet 171 and water outlet 151 of the water pump). The underlying functionality of each one of the intermittent water pump powering techniques is to initiate the siphon effect by priming the passage extending between the water inlet 171 of the water pump 104 and the water outlet 151 of the water pump 104 as a result of at least one period of electrical power provided to the water pump 104 during an instance of intermittent output of electrical power to the water pump 104 within an instance of a prescribed time period during which the water level sensing device 106 (or other type of water presence sensing device) is indicating that the water level within the base 120 is above a threshold water level.

Figure 5:
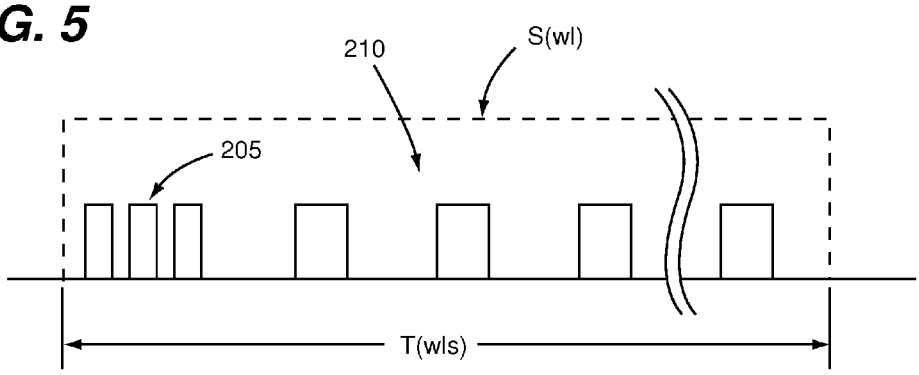
FIG. 5 is a diagrammatic view showing an intermittent water pump powering technique configured in accordance with an embodiment of the present invention.

FIG. 5 shows an intermittent water pump powering technique 200 configured in accordance with an embodiment of the present invention. For a given period of time T(wls) that the water level sensing device 106 is indicating that the water level within the base 120 is above a threshold water level (e.g., via water level signal (wl)), the power control module 112 causes a plurality of pump priming electrical power pulses 205 to be provided from the battery 110 to the water pump 104 followed by causing a plurality of siphon-maintaining electrical power pulse 210 to be provided from the battery 110 to the water pump 104. It is disclosed herein that a duration of each pump priming electrical power pulse 205 can be the substantially the same as or substantially different than a duration of each siphon-maintaining electrical power pulse 210. As shown, a duration of a dwell period (i.e., period no electrical power is provided to the water pump 104) between adjacent pump priming electrical power pulses 205 is substantially less than a duration of a dwell period between adjacent siphon-maintaining electrical power pulses 210. As also shown, a duration of a dwell period between a last one of the pump priming electrical power pulses 205 and a first one of the siphon-maintaining electrical power pulses 210 is substantially greater than the dwell period between adjacent pump priming electrical power pulses 205.

In accordance with one or more embodiments of an intermittent water pump powering technique configured in accordance with an embodiment of the present invention, the duration of one of the pump priming electrical power pulses 205 can be different that the duration of a different one of the pump priming electrical power pulses 205. In accordance with one or more embodiments of an intermittent water pump powering technique configured in accordance with an embodiment of the present invention, the duration of one of the siphon-maintaining electrical power pulses 210 can be different that the duration of a different one of the siphon-maintaining electrical power pulses 210. In accordance with one or more embodiments of an intermittent water pump powering technique configured in accordance with an embodiment of the present invention, a single pump priming electrical power pulse 205 can be implemented rather than a plurality of pump priming electrical power pulses 205 (e.g., of a duration the same of different than one or more of the subsequent siphon-maintaining electrical power pulses 210).

Figure 6:
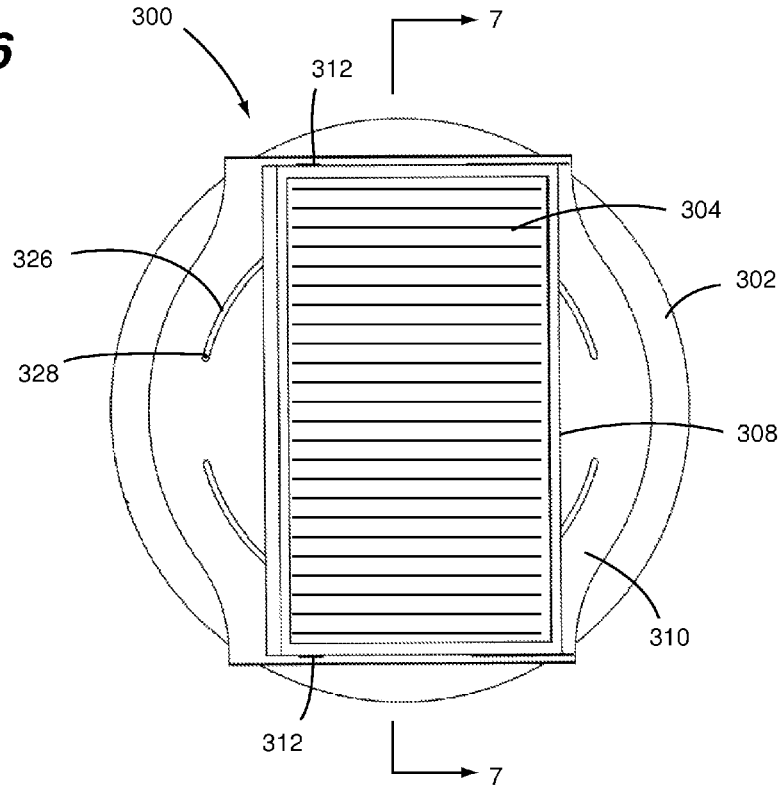
FIG. 6 is a top view showing an embodiment of a hood assembly enabling a solar panel thereof to be rotated and tilted.
Figure 7:
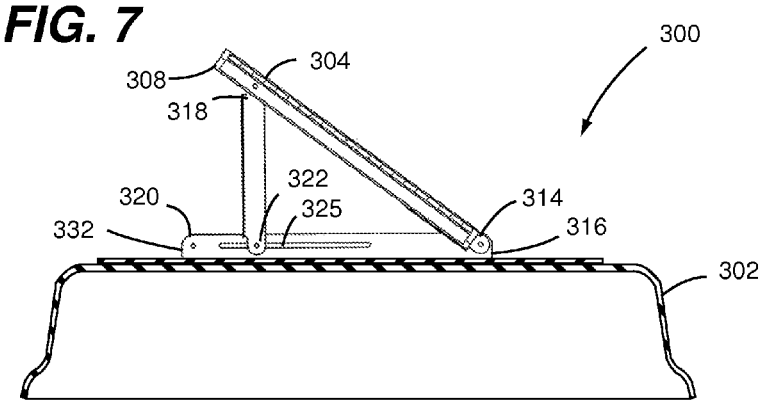
FIG. 7 is a cross-sectional view taken along the line 7-7 in FIG. 6.

Referring now to FIGS. 6 and 7, an alternate embodiment of a hood assembly 300 is shown. The hood assembly 300 can be used in place of the hood assembly 133 of the water pumping system 100 discussed above in reference to FIGS. 1-3. The hood assembly 300 includes a hood 302, a solar panel 304 and a mounting bracket 306. The mounting bracket 306 includes a top plate 308, a bottom plate 310 and struts 312. The solar panel 304 is mounted on the top plate 308. The top plate 308 has a first edge portion 314 thereof pivotably attached to the bottom plate 310 adjacent to a first edge portion 316 of the bottom plate 310. A first end portion 318 of each one of the struts 312 is pivotably attached to the top plate 308 adjacent to a second edge portion 320 of the top plate 308. A second end portion 322 of each one of the struts 312 is pivotably and translatably attached to the bottom plate 310 adjacent to a second edge portion 324 of the bottom plate 310 through a slot 325 in a mating portion of the bottom plate 310. The bottom plate 310 is rotatably mounted on the hood 302 through a plurality of slots 326 that are each engaged with a respective engagement member 328 (e.g., threaded fastener) of the hood 302. In this regard, the top panel 308 and thus the solar panel 304 can be tilted with respect to the hood 302 and the bottom plate 310 and thus the solar panel 304 can be rotated with respect to the hood 302. The top plate 308 can be secured in a fixed position with respect to the bottom plate 310 such as, for example, through use of a threaded fastener or other type of implement that inhibits pivoting at an one or more pivot points of the top plate 308 and/or strut 312. This ability for the solar panel 304 to be selectively tilted and rotated with respect to the hood 302 is beneficial for optimizing power output from the solar panel 304 after the water pumping system comprising the hood assembly 300 is installed.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A water pumping system, comprising:

a housing having at least one internal chamber, wherein at least one water inlet passage and at least one water outlet passage extends between an exterior surface of the housing and an interior space of the at least one internal chamber;

a power control module located in the at least one internal chamber, wherein the power control module includes a water pump power output interface, a pump actuation signal interface and a power input interface, wherein the power control module intermittently outputs electrical power to the water pump power output interface for each instance of a prescribed time period during which a water level signal is provided at the water presence signal interface, wherein the power control intermittently outputting electrical power to the water pump power output interface includes the power control module outputting a plurality of pump priming electrical power pulses followed by at least one siphon-maintaining electrical power pulse;

a water level sensing device located within the at least one internal chamber, wherein the water level sensing device is electrically connected to the pump actuation signal interface of the power control module for enabling the water presence signal to be provided therefrom to the pump actuation signal interface when the water level sensing device detects a pump actuation condition exists;

a water pump located within the at least one internal chamber and having a water outlet thereof connected to the at least one water outlet passage of the housing, wherein the water pump is electrically connected to the water pump power output interface of the power control module for enabling the intermittently outputted electrical power to be provided thereto and wherein the water pump is operable in a non-powered state for causing water to flow through a passage extending between a water inlet of the water pump and the water outlet of the water pump by a siphon effect initiated by priming the passage extending between the water inlet of the water pump and the water outlet of the water pump with water as a result of at least one period of electrical power provided to the water pump during the instance of the intermittent output of electrical power to the water pump power output interface; and at least one solar electric panel mounted on the housing, wherein the at least one solar electric panel is electrically connected to the power input interface of the power control module.

2. The water pumping system of claim 1 wherein a duration of each one of the pump priming electrical power pulses is less than a dwell period siphon-maintaining electrical power pulse.

3. The water pumping system of claim 2 wherein:

the power control module outputs a plurality of siphon-maintaining electrical power pulses;

a dwell period between adjacent ones of the pump priming pulses is less than a dwell period between each one of the siphon-maintaining electrical power pulses; and the duration of each one of the pump priming pulses is less than the dwell period between the last one of the pump priming pulses and the first one of the siphon-maintaining electrical power pulse.

4. The water pumping system of claim 1 wherein:

the housing includes a first internal chamber and a second internal chamber;

the power control module is located within the first internal chamber;

the water pump and the water level sensing device are located within the second internal chamber;

a bottom wall of the housing defines a lower end portion of the second internal chamber; and the first internal chamber is located entirely above the second internal chamber.

5. The water pumping system of claim 1, further comprising:

a mounting bracket coupled between the housing and the solar electric panel;

wherein the mounting bracket is rotatable attached to the housing; and wherein the mounting bracket enables the solar panel to be tilted with respect to the housing.

6. The water pumping system of claim 5 wherein:

the housing includes a first internal chamber and a second internal chamber;

the power control module is located within the first internal chamber;

the water pump and the water level sensing device are located within the second internal chamber;

a bottom wall of the housing defines a lower end portion of the second internal chamber; and the first internal chamber is located entirely above the second internal chamber.

7. The water pumping system of claim 5 wherein:

a duration of each one of the pump priming electrical power pulses is less than a dwell period between a last one of the pump priming pulses and a first one of the at least one siphon-maintaining electrical power pulse;

the power control module outputs a plurality of siphon-maintaining electrical power pulses;

a dwell period between adjacent ones of the pump priming pulses is less than a dwell period between each one of the siphon-maintaining electrical power pulses; and the duration of each one of the pump priming pulses is less than the dwell period between the last one of the pump priming pulses and the first one of the siphon-maintaining electrical power pulses.

8. The water pumping system of claim 7 wherein:

the housing includes a first internal chamber and a second internal chamber;

the power control module is located within the first internal chamber;

the water pump and the water level sensing device are located within the second internal chamber;

a bottom wall of the housing defines a lower end portion of the second internal chamber; and the first internal chamber is located entirely above the second internal chamber.

9. A water pumping system, comprising:

a housing having a first internal chamber and a second internal chamber, wherein at least one passage extends between an interior space of the first internal chamber and an interior space of the second internal chamber and wherein at least one water inlet passage and at least one water outlet passage extend between an exterior surface of the housing and the interior space of the second internal chamber;

a power control module in the first internal chamber, wherein the power control module includes a water pump power output interface and a water level signal interface, wherein the power control module intermittently outputs electrical power to the water pump power output interface for each instance of a prescribed time period during which a water level signal is provided at the water level signal interface, wherein the power control intermittently outputting electrical power to the water pump power output interface includes the power control module outputting a plurality of pump priming electrical power pulses followed by at least one siphon-maintaining electrical power pulse;

a water level sensing device located within the second internal chamber, wherein the water level sensor is electrically connected to the water level signal interface of the power control module by a water level signal conducting structure that extends through the at least one passage that extending between the interior space of the first internal chamber and the interior space of the second internal chamber for enabling the water level signal to be provided therefrom; and a water pump located within the second internal chamber and having a water outlet thereof connected to the at least one water outlet passage of the housing, wherein the water pump is electrically connected to the water pump power output interface of the power control module by an electrical power transmitting structure that extends through the at least one passage extending between the interior space of the first internal chamber and the interior space of the second internal chamber for enabling the intermittently outputted electrical power to be provided thereto and wherein the water pump is operable in a non-powered state for causing water to flow through a passage extending between a water inlet of the water pump and the water outlet of the water pump at least partially by a siphon effect generated by priming the passage extending between the water inlet of the water pump and the water outlet of the water pump as a result of at least one period of electrical power provided to the water pump during the instance of the intermittent output of electrical power to the water pump power output interface.

10. The water pumping system of claim 9 wherein a duration of each one of the pump priming electrical power pulses is less than a dwell period between a last one of the pump priming pulses and a first one of the at least one siphon-maintaining electrical power pulse.

11. The water pumping system of claim 10 wherein:

the power control module outputs a plurality of siphon-maintaining electrical power pulses;

a dwell period between adjacent ones of the pump priming pulses is less than a dwell period between each one of the siphon-maintaining electrical power pulses; and the duration of each one of the pump priming pulses is less than the dwell period between the last one of the pump priming pulses and the first one of the siphon-maintaining electrical power pulses.

12. The water pumping system of claim 9 wherein:

a bottom wall of the housing defines a lower end portion of the second internal chamber; and the first internal chamber is located entirely above the second internal chamber.

13. A water pumping system, comprising:

a housing having a base, a hood and an interior space divider, wherein the base has a bottom wall and an upper edge portion; wherein the hood has a top wall and an lower edge portion, wherein the interior space divider is mounted on a mating interior surface of the base thereby defining a first internal chamber between the base and the interior space divider, wherein the upper edge portion of the base is engaged with the lower edge portion of the hood thereby defining a second internal chamber between the hood and the interior space divider, wherein at least one passage extends though the interior space divider, wherein at least one water inlet passage extends between an exterior surface of the base and the first internal chamber, and wherein at least one water outlet passage extends between the exterior surface of the base and the first internal chamber;

a water pump within the first internal chamber and having a water outlet thereof connected to the at least one water outlet passage of the base;

a water level sensing device within the first internal chamber;

a solar electric panel mounted on at least one of the hood and the base;

a battery within the second internal chamber; and a power control module within the second internal chamber, wherein the power control module is electrically coupled to the battery, the solar electric panel, the water level sensing device and the water pump, wherein the power control module causes electrical power to be provided from at least one of the battery and the solar electric panel to the water pump when a water level signal is received thereby from the water level sensing device, wherein the power control module intermittently outputs electrical power to the water pump power output interface for each instance of a prescribed time period during which a water level signal is provided at the water presence signal interface, wherein the power control intermittently outputting electrical power to the water pump power output interface includes the power control module outputting a plurality of pump priming electrical power pulses followed by a plurality of siphon-maintaining electrical power pulses, and wherein a duration of each one of the pump priming electrical power pulses is less than a dwell period between a last one of the pump priming pulses and a first one of the siphon-maintaining electrical power pulses.

14. The water pumping system of claim 13 wherein:

the power control module outputs the plurality of siphon-maintaining electrical power pulses;

a dwell period between adjacent ones of the pump priming pulses is less than a dwell period between each one of the siphon-maintaining electrical power pulses; and the duration of each one of the pump priming pulses is less than the dwell period between the last one of the pump priming pulses and the first one of the siphon-maintaining electrical power pulses.

* * * * *